US008508417B2

(12) United States Patent
Onaka et al.

(10) Patent No.: US 8,508,417 B2
(45) Date of Patent: Aug. 13, 2013

(54) ANTENNA AND RADIO COMMUNICATION DEVICE

(75) Inventors: Kengo Onaka, Kanagawa-ken (JP); Takashi Ishihara, Tokyo-to (JP); Munehisa Watanabe, Shiga-ken (JP); Takuya Murayama, Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 423 days.

(21) Appl. No.: 12/816,113

(22) Filed: Jun. 15, 2010

(65) Prior Publication Data

US 2010/0321256 A1 Dec. 23, 2010

(30) Foreign Application Priority Data

Jun. 18, 2009 (JP) ..... 2009-144954

(51) Int. Cl.
*H01Q 1/24* (2006.01)

(52) U.S. Cl.
USPC ..... 343/702; 343/741; 343/846

(58) Field of Classification Search
USPC ..... 343/702, 741, 828, 831, 833, 846
See application file for complete search history.

(56) References Cited

U.S. PATENT DOCUMENTS

| | | | | |
|---|---|---|---|---|
| 6,950,072 | B2 * | 9/2005 | Miyata et al. | 343/702 |
| 7,298,340 | B2 * | 11/2007 | Ohba | 343/702 |
| 7,375,695 | B2 * | 5/2008 | Ishizuka et al. | 343/745 |
| 7,538,732 | B2 | 5/2009 | Ishihara et al. | |

FOREIGN PATENT DOCUMENTS

| | | | |
|---|---|---|---|
| CN | 1497774 | A | 5/2004 |
| CN | 101099265 | A | 1/2008 |
| JP | H10-56314 | A | 2/1998 |
| JP | 2001-223519 | A | 8/2001 |
| JP | 2001-339226 | A | 12/2001 |

OTHER PUBLICATIONS

Japanese Office Action "Notification of Reasons for Rejection" dated Oct. 18, 2011; Japanese Patent Application No. 2009-144954 with translation.

The First Office Action issued on Nov. 20, 2012, from the State Intellectual Property Office of People's Republic of China, which corresponds to Chines Patent Application No. 201010202598.4 and is related to U.S. Appl. No. 12/816,113 with partial translation.

* cited by examiner

*Primary Examiner* — James H Cho
(74) *Attorney, Agent, or Firm* — Studebaker & Brackett PC

(57) ABSTRACT

A dielectric base of an antenna element has a first external terminal at a position substantially corresponding to a node of voltage-distribution distribution of a harmonic wave distributed in a feeding radiation electrode and a second external terminal at a position substantially corresponding to a node of voltage-distribution distribution of a harmonic wave distributed in a non-feeding radiation electrode. A substrate has a ground electrode and a first external-terminal electrode to which the first external terminal is connected. An extension element extends from the first external-terminal electrode so as to be separated from the ground electrode.

16 Claims, 8 Drawing Sheets

Fig. 1
Prior Art
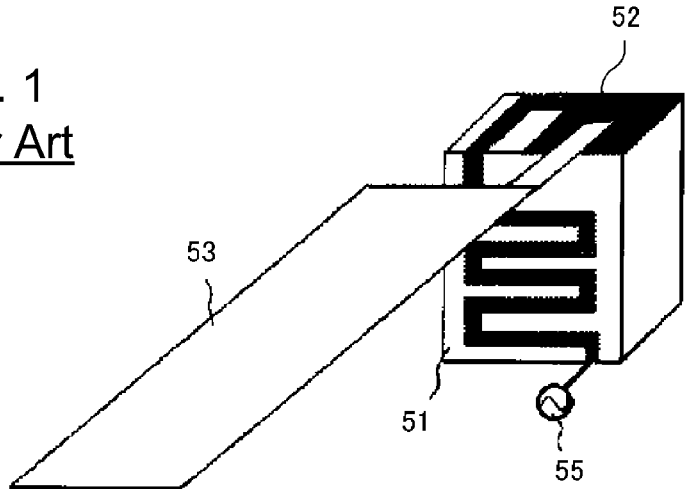
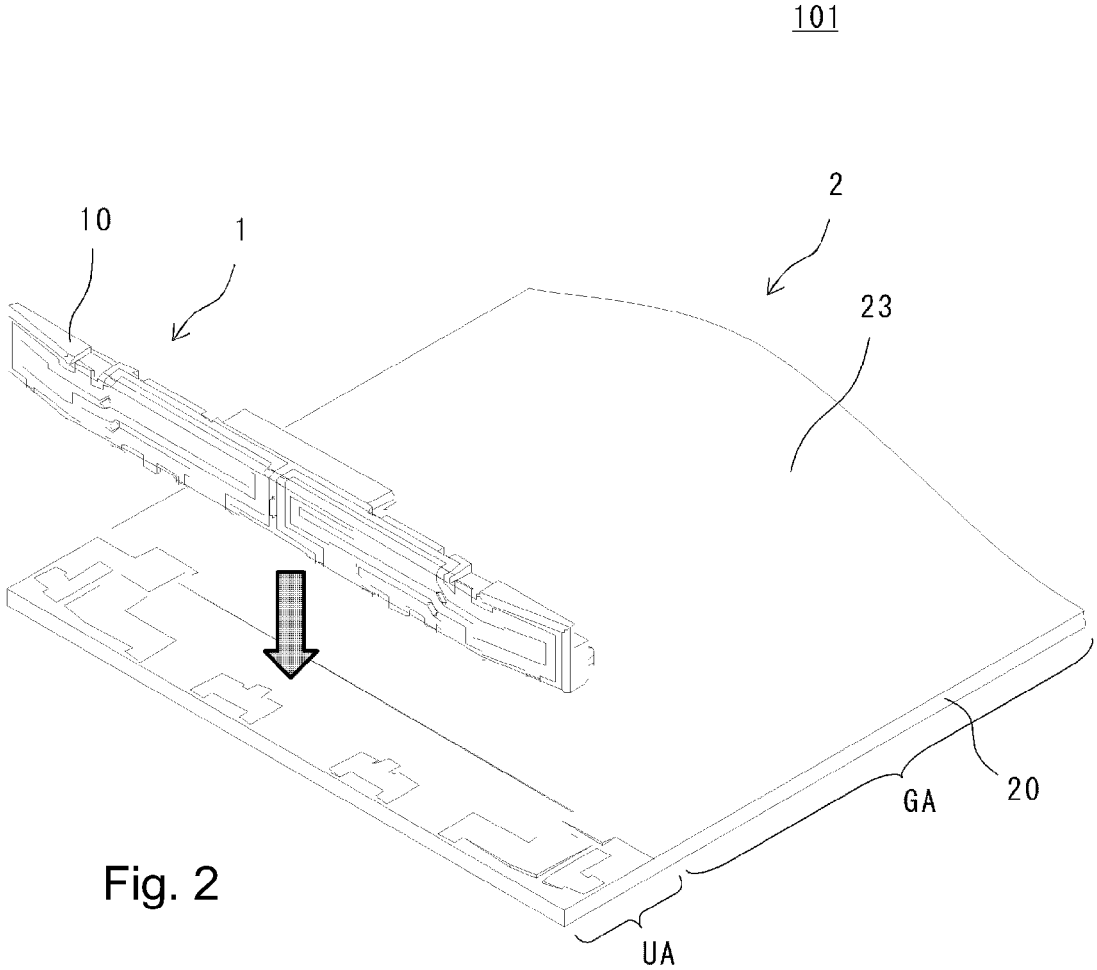
Fig. 2

1
10
11f
12f 11g
11k
12k
12g 11h
11j
11c
11e
12e
12c
12j
12h 11d
12d
11i
11b
11a
12b
12i
12a

FEEDING PART
NON-FEEDING PART

ANTENNA AND RADIO COMMUNICATION DEVICE

CROSS REFERENCE TO RELATED APPLICATIONS

The present application claims priority to Japanese Patent Application No. 2009-144954 filed on Jun. 18, 2009, the entire contents of which are hereby incorporated herein by reference in their entirety.

FIELD OF THE INVENTION

The present invention relates to antennas used for radio communication devices such as mobile phone units and to radio communication devices including the same.

BACKGROUND

As the size of portable wireless devices is decreasing, the space for receiver antennas thereof is also decreasing. Japanese Unexamined Patent Application Publication (JP-A) No. 2001-339226 describes an antenna having improved antenna characteristics and which can be effectively used in a limited space.

The structure of the antenna described in JPA-2001-339226 will now be described with reference to FIG. 1. In FIG. 1, a conductive tabular auxiliary element 53 is attached to an antenna element including a dielectric 51 and an electrode pattern 52 formed on the dielectric. The electrode pattern 52 is connected to a feeding point 55.

According to the antenna described in JP-A-2001-339226, the resonant frequency of the antenna is reduced due to an effect of wavelength shortening obtained by using the dielectric element and an effect of the conductive tabular auxiliary element 53 connected thereto, and as a result, the antenna characteristics can be improved while the limited space for the antenna is effectively used.

However, the antenna described in JP-A-2001-339226 requires the conductive tabular auxiliary element 53 in addition to the dielectric 51 in order to operate at a desired frequency. Moreover, when the antenna described in JP-A-2001-339226 is of a multiband type that operates with desired fundamental and harmonic waves, the antenna also requires the tabular auxiliary element 53 so that the frequencies of the fundamental and harmonic waves are not changed. That is, the antenna needs to be designed on the premise that the tabular auxiliary element 53 exists.

SUMMARY

In an exemplary embodiment consistent with the claimed invention, an antenna includes an antenna element including a dielectric base having a feeding radiation electrode formed on the dielectric base. The antenna includes a substrate having an ungrounded area in which no ground electrode is formed provided at an end portion of the substrate, and the antenna element is provided in the ungrounded area of the substrate. The feeding radiation electrode has a feeding terminal at a feeding end thereof and extends along a surface of the dielectric base in a helical or looped manner so as to return to a position adjacent to the feeding terminal. The feeding radiation electrode has a first external terminal at a position on the dielectric base substantially corresponding to a node of the distribution of voltage intensity of a harmonic wave distributed in the feeding radiation electrode. The substrate has a first external-terminal electrode to which the first external terminal is connected. The antenna includes a first extension element that extends from the first external-terminal electrode so as to be separated from the ground electrode.

According to a more specific exemplary embodiment, for example, the antenna may further include a second extension element. The dielectric base may have a non-feeding radiation electrode formed thereon in addition to the feeding radiation electrode. The non-feeding radiation electrode can have a ground terminal at a ground end thereof and extends along the surface of the dielectric base in a helical or looped manner so as to return to a position adjacent to the ground terminal. The non-feeding radiation electrode can have a second external terminal at a position on the dielectric base substantially corresponding to a node of the distribution of voltage intensity of a harmonic wave distributed in the non-feeding radiation electrode. The substrate can have a second external-terminal electrode to which the second external terminal is connected. The second extension element can extend from the second external-terminal electrode so as to be separated from the ground electrode.

In another more specific exemplary embodiment, for example, the substrate may have a feeding terminal electrode to which the feeding terminal is connected, and an inductance element can be connected between the first external-terminal electrode and the feeding terminal electrode.

In yet another more specific exemplary embodiment, for example, the substrate can have a feeding terminal electrode to which the feeding terminal is connected and a ground terminal electrode to which the ground terminal is connected, and an inductance element can be connected either or both between the first external-terminal electrode and the feeding terminal electrode and between the second external-terminal electrode and the ground terminal electrode.

In another more specific embodiment, for example, the first extension element can be disposed, or provided inside a casing, and can be electrically connected to the first external-terminal electrode with a flexible or elastic connecting member interposed therebetween.

In another more specific embodiment, for example, at least one of the first extension element or the second extension element can be disposed, or provided inside a casing, and the first extension element can be electrically connected to the first external-terminal electrode with a flexible or elastic connecting member interposed therebetween or the second extension element can be electrically connected to the second external-terminal electrode with a flexible or elastic connecting member interposed therebetween.

In yet other more exemplary embodiments, a radio communication device includes an antenna having a structure according to any of the above embodiments inside a casing of the device.

Other features, elements, characteristics and advantages of the present invention will become more apparent from the following detailed description of preferred embodiments of the present invention with reference to the attached drawings.

BRIEF DESCRIPTION OF THE DRAWINGS

FIG. 1 illustrates the structure of an antenna described in JP-A-2001-339226.

FIG. 2 is a fragmentary exploded perspective view illustrating the structure of an antenna 101 incorporated in a casing of a radio communication device such as a mobile phone unit according to an exemplary embodiment.

DETAILED DESCRIPTION

Figures 3A, 3B, 3C, 3D, 3E, 3F:
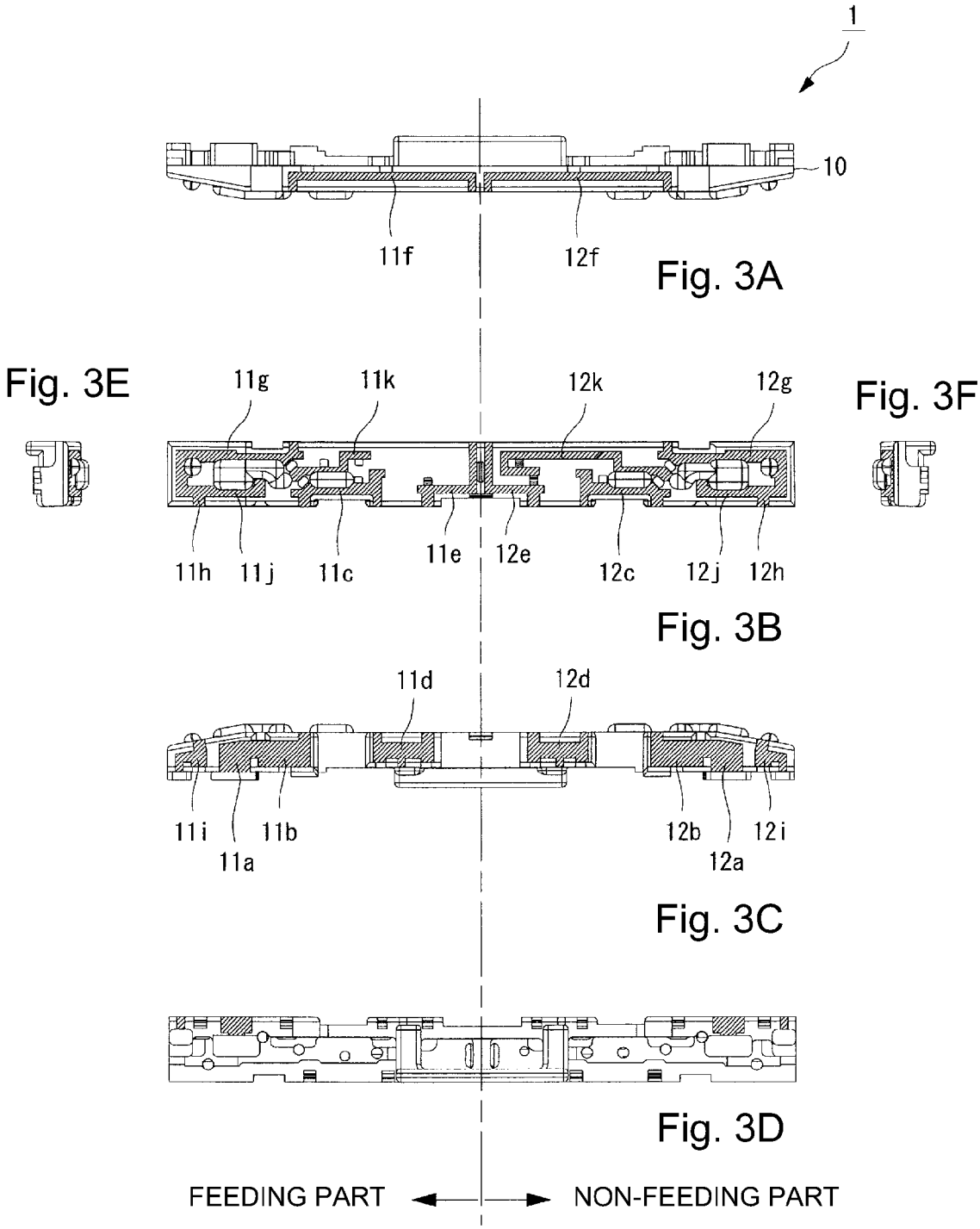
FIGS. 3A to 3F are six orthographic views illustrating an antenna element 1 shown in FIG. 2.

The structure of an antenna and a radio communication device including the antenna according to a first exemplary embodiment will now be described with reference to FIGS. 2 to 8.

FIG. 2 is a fragmentary exploded perspective view illustrating the structure of the antenna incorporated in a casing of the radio communication device such as a mobile phone unit. An antenna 101 includes an antenna element 1 including a dielectric base 10, having a shape along the shape of the casing of the radio communication device, on which predetermined electrodes are formed and a substrate 2 including a base 20 on which predetermined electrodes are formed.

The substrate 2 has a grounded area GA in which a ground electrode 23 is formed on the base 20 and an ungrounded area UA in which no ground electrode 23 is formed extending in the vicinity of a side of the substrate 2. The antenna element 1 is surface-mounted in the ungrounded area UA so as to be separated from the grounded area GA as far as possible.

When this antenna 101 is incorporated in a mobile phone unit of the foldable type, the antenna is disposed adjacent to a hinge or a bottom portion (microphone).

FIGS. 3A to 3F are six orthographic views illustrating the antenna element 1 shown in FIG. 2. FIG. 3A is a top view, FIG. 3B is a front view, FIG. 3C is a bottom view, FIG. 3D is a rear view, FIG. 3E is a left side view, and FIG. 3F is a right side view.

The dielectric base 10 and the electrode patterns formed thereon are symmetrical with respect to an alternating long and short dash line passing through FIGS. 3A to 3D. In this embodiment, the antenna element 1 includes a feeding part at the left side of the alternating long and short dash line and a non-feeding part at the right side on the single dielectric base 10.

First, the feeding part will be described. A first external terminal 11*i*, a feeding terminal 11*a*, and electrodes 11*b* and 11*d* are formed on the bottom surface of the dielectric base 10. Electrodes 11*c*, 11*e*, 11*g*, 11*j*, and 11*k* are formed on the front surface of the dielectric base 10. Moreover, an external-terminal leading portion 11*h* extends from the front surface to the bottom surface. An electrode 11*f* is formed on the top surface of the dielectric base 10.

The above-described terminals and electrodes are connected from the feeding terminal 11*a* to the electrodes 11*b*, 11*c*, 11*d*, 11*e*, 11*f*, 11*g*, 11*j*, and 11*k*. The external-terminal leading portion 11*h* is electrically connected to the first external terminal 11*i* on the bottom surface. The electrode 11*k* extends from the electrode 11*j*. In this manner, these components form a helical or looped feeding radiation electrode.

Next, the non-feeding part will be described. A second external terminal 12*i*, a ground terminal 12*a*, and electrodes 12*b* and 12*d* are formed on the bottom surface of the dielectric base 10. Electrodes 12*c*, 12*e*, 12*g*, 12*j*, and 12*k* are formed on the front surface of the dielectric base 10. Moreover, an external-terminal leading portion 12*h* extends from the front surface to the bottom surface. An electrode 12*f* is formed on the top surface of the dielectric base 10.

The above-described terminals and electrodes are connected from the ground terminal 12*a* to the electrodes 12*b*, 12*c*, 12*d*, 12*e*, 12*f*, 12*g*, 12*j*, and 12*k*. The external-terminal leading portion 12*h* is electrically connected to the second external terminal 12*i* on the bottom surface. The electrode 12*k* extends from the electrode 12*j*. In this manner, these components form a helical or looped non-feeding radiation electrode.

Figure 4:
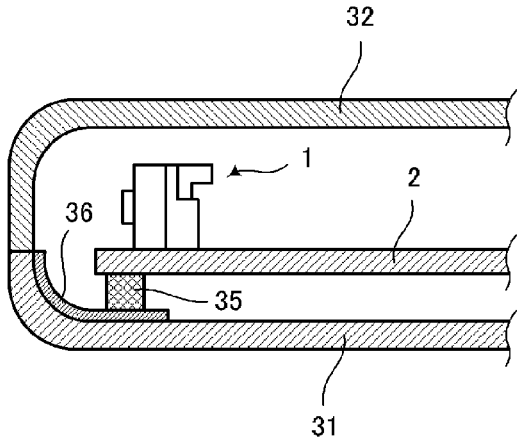
FIG. 4 is a cross-sectional view of a principal part of the mobile phone unit including the antenna 101 shown in FIGS. 2 and 3A to 3F.

FIG. 4 is a cross-sectional view of a principal part of the mobile phone unit including the antenna 101 shown in FIGS. 2 and 3A to 3F.

As shown in FIG. 4, the substrate 2 having the antenna element 1 mounted thereon is accommodated in a space formed by a lower casing 31 and an upper casing 32 of the mobile phone unit. The substrate 2 includes a high frequency circuit and a baseband circuit so as to function as a mobile phone unit.

A first external-terminal electrode 21*i* (see FIG. 5) to which the first external terminal of the antenna element 1 is connected and a second external-terminal electrode 22*i* (see FIG. 5) to which the second external terminal of the antenna element 1 is connected are formed on the top surface of the substrate 2.

A connecting member 33 (see FIG. 5) electrically connected to the first external-terminal electrode 21*i* and a connecting member 35 shown in FIG. 4 electrically connected to the second external-terminal electrode 22*i* are disposed, or provided on the bottom surface of the substrate 2.

Figure 5:
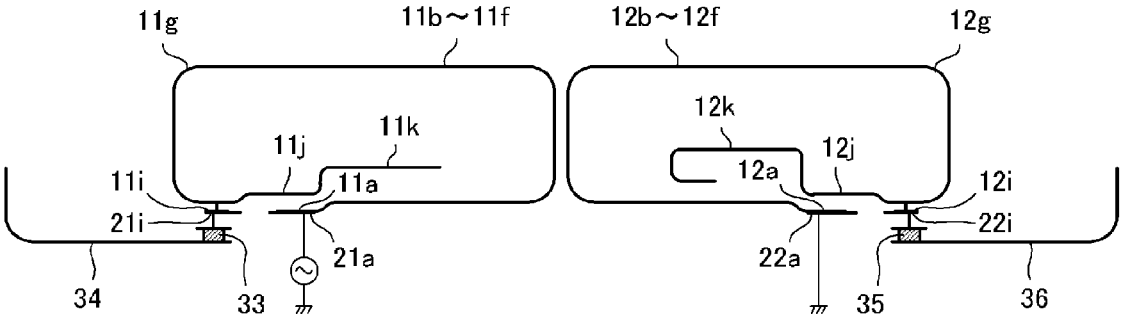
FIG. 5 is an equivalent circuit diagram of the antenna 101 shown in FIGS. 2 to 4.

With reference to FIG. 5, which is an equivalent circuit diagram of the antenna 101 shown in FIGS. 2 to 4, an extension element 34 for the feeding part and an extension element 36 for the non-feeding part are formed on the inner surface of the lower casing 31 by, for example, plating. These extension elements extend so as to be separated from the ground electrode formed on the substrate 2.

The extension element 36 for the non-feeding part shown in FIG. 4 is connected to the second external-terminal electrode 22*i* with the connecting member 35 and a conductive through-hole of the substrate interposed therebetween. Similarly, the extension element 34 for the feeding part is connected to the first external-terminal electrode 21*i* with the connecting member 33 and a conductive through-hole interposed therebetween. The connecting members 33 and 35 are flexible or elastic members such as gaskets formed of, for example, metal wool.

Returning again to FIG. 5, the feeding part will be described. The loop extending from the feeding terminal 11*a* to the electrode 11*k* through the electrodes 11*b* to 11*g*, and the electrode 11*j*, forms a radiation electrode for a fundamental wave resonating at approximately a quarter of a wavelength and a radiation electrode for a harmonic wave resonating at approximately three-quarters of a wavelength.

The first external terminal 11*i* is electrically connected to the first external-terminal electrode 21*i* on the top surface of the substrate 2. The first external-terminal electrode 21*i* is electrically connected to the extension element 34 with the connecting member 33 interposed therebetween.

Similarly, the loop in the non-feeding part extending from the ground terminal 12*a* to the electrode 12*k* through the electrodes 12*b* to 12*g*, and the electrode 12*j*, forms a non-feeding radiation electrode for a fundamental wave resonating at approximately a quarter of a wavelength and a non-feeding radiation electrode for a harmonic wave resonating at approximately three-quarters of a wavelength.

The second external terminal 12*i* is electrically connected to the second external-terminal electrode 22*i* on the top surface of the substrate 2. The second external-terminal electrode 22*i* is electrically connected to the extension element 36 with the connecting member 35 interposed therebetween.

Figure 6A:
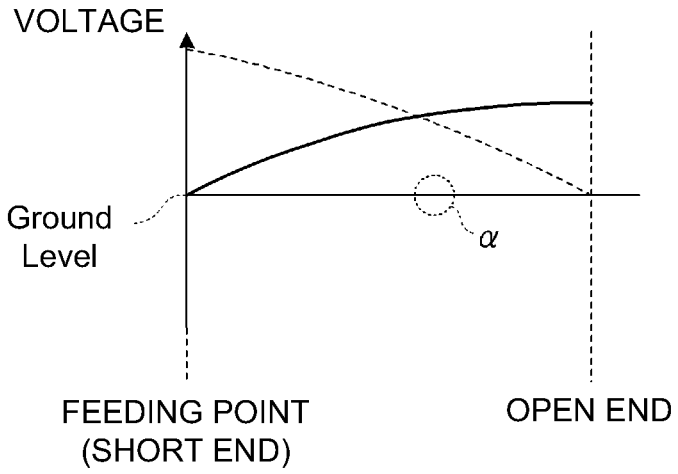
FIG. 6A illustrates distributions of voltage intensity and current intensity of a fundamental wave generated by a radiation electrode for the fundamental wave.
Figure 6B:
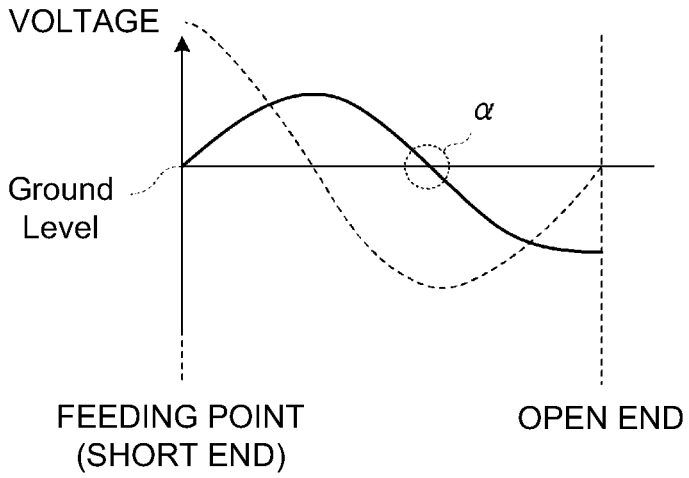
FIG. 6B illustrates distributions of voltage intensity and current intensity of a harmonic wave generated by a radiation electrode for the harmonic wave.

FIG. 6A illustrates distributions of voltage intensity and current intensity of a fundamental wave excited by a radiation electrode for the fundamental wave, and FIG. 6B illustrates distributions of voltage intensity and current intensity of a harmonic wave excited by a radiation electrode for the harmonic wave. In FIGS. 6A and 6B, solid lines indicate voltage intensity, and broken lines indicate current intensity. As is clear from FIG. 6A, the radiation electrode for the fundamental wave resonates at a quarter of a wavelength. In FIG. 6A, a position indicated by a substantially corresponds to a node of the distribution of voltage intensity of the harmonic wave (where the current is substantially maximized) distributed in the radiation electrode. This position corresponds to the first external terminal 11*i* and the second external terminal 12*i* shown in FIG. 5.

The external terminal 11*i* is connected to the first external-terminal electrode 21*i* to which the extension element 34 is connected with the connecting member 33 interposed therebetween. Similarly, the external terminal 12*i* is connected to the second external-terminal electrode 22*i* to which the extension element 36 is connected with the connecting member 35 interposed therebetween. That is, the extension element 34 extends from a position substantially corresponding to a node of the distribution of voltage intensity of the harmonic wave distributed in the feeding radiation electrode, and the extension element 36 extends from a position substantially corresponding to a node of the distribution of voltage intensity of the harmonic wave distributed in the non-feeding radiation electrode.

With this structure, the electric field of the fundamental wave of the feeding radiation electrode is widely distributed by the extension element 34, and the electric field of the fundamental wave of the non-feeding radiation electrode is widely distributed by the extension element 36, resulting in an improvement in antenna performance. The harmonic waves are not affected since the extension elements extend from the nodes of voltage-intensity distributions. As a result, the frequencies of the fundamental waves (low band) can be easily adjusted while the frequencies of the harmonic waves (high band) are fixed.

Figure 7:
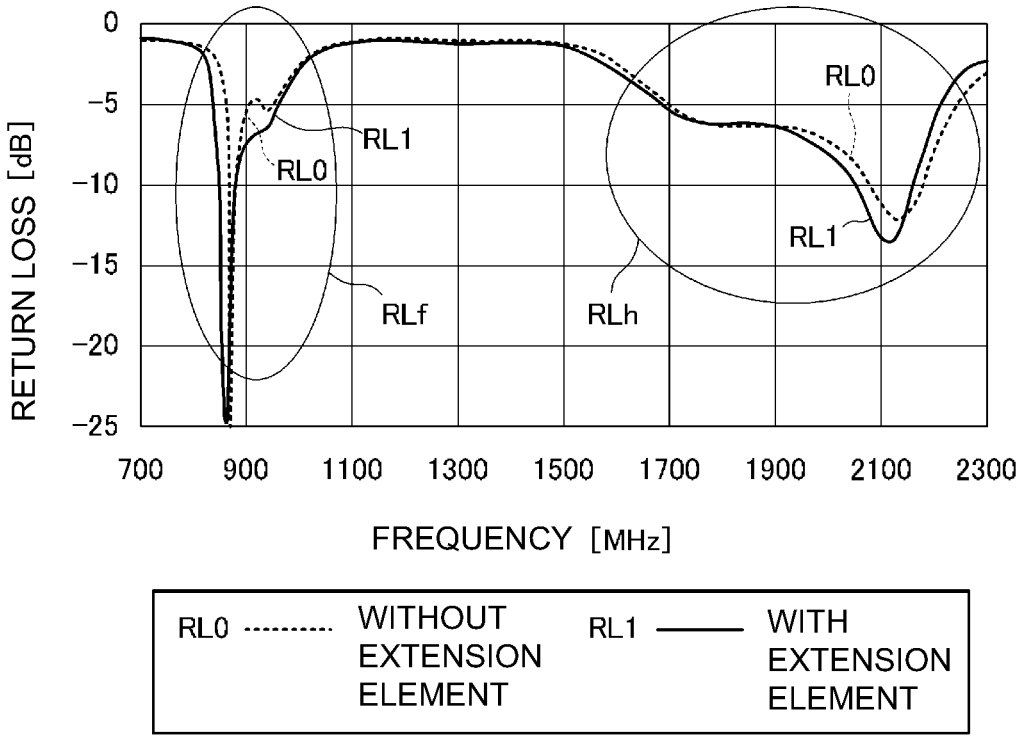
FIG. 7 illustrates a reflection characteristic of the antenna 101 according to an exemplary embodiment.

FIG. 7 illustrates a reflection characteristic of the antenna 101 according to the first exemplary embodiment. In FIG. 7, a portion of a small return loss indicated by RLf in a low frequency band corresponds to the resonance in the fundamental wave mode, and that indicated by RLh in a high frequency band corresponds to the resonance in the harmonic wave mode. As is clear from FIG. 7, the antenna resonates at two frequencies using the feeding radiation electrode and the non-feeding radiation electrode.

When a reflection characteristic RL1 obtained using the extension elements 34 and 36 is compared with a reflection characteristic RL0 obtained without the extension elements, the return loss is reduced in the fundamental wave mode (low band). This is because the volume of the antenna is increased and the electric fields are widely distributed by the additional extension elements.

Figure 8A:
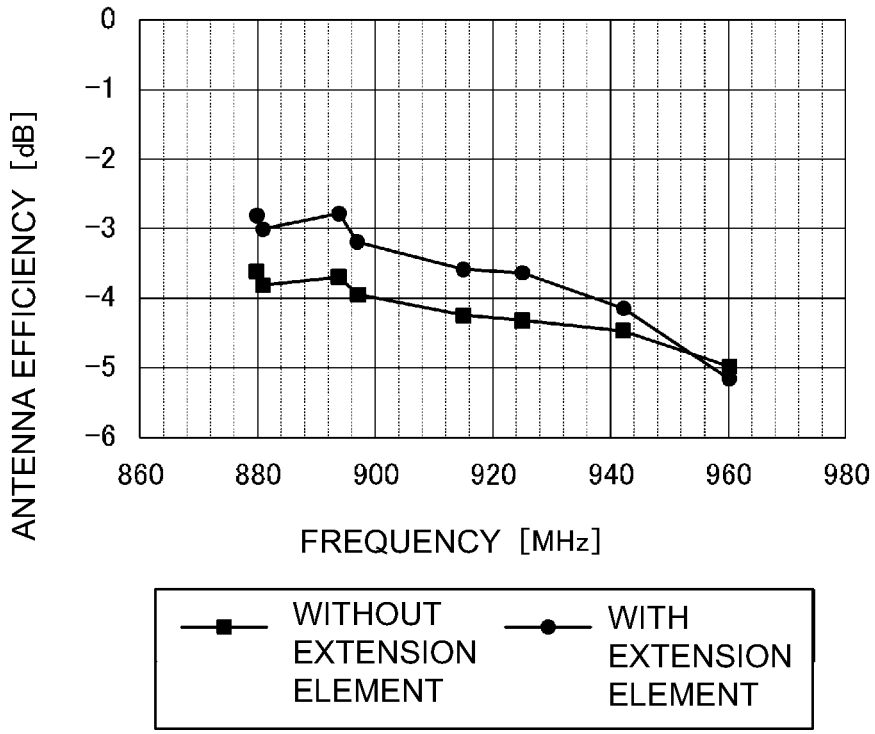
FIG. 8A illustrates a difference in antenna efficiency with or without extension elements in a low band.
Figure 8B:
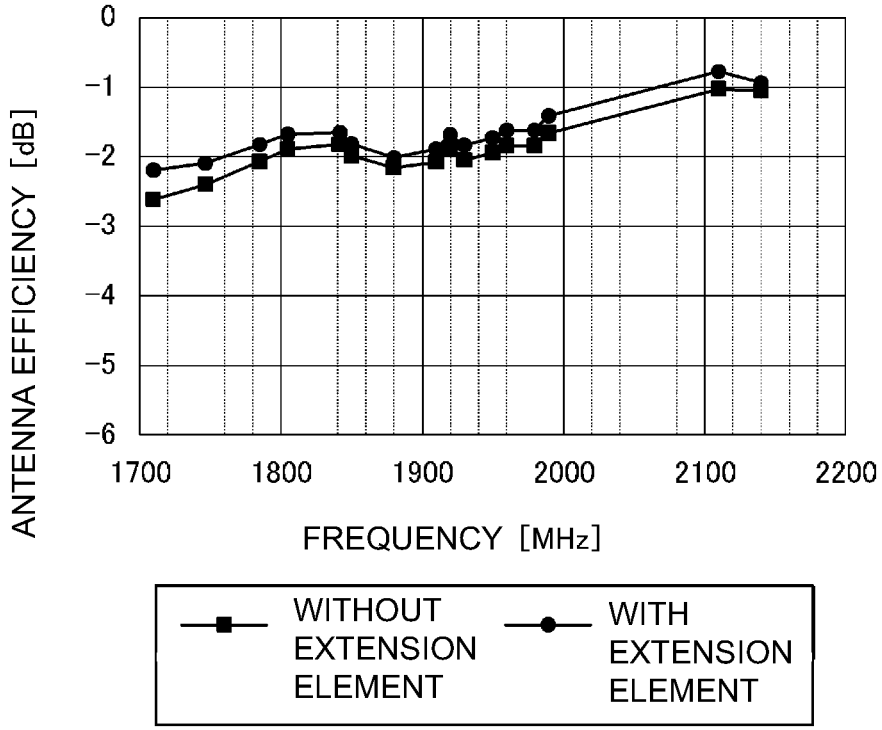
FIG. 8B illustrates a difference in the antenna efficiency with or without the extension elements in a high band.

FIG. 8A illustrates a difference in antenna efficiency with or without the extension elements in the low band, and FIG. 8B illustrates a difference in the antenna efficiency with or without the extension elements in the high band.

As described above, the extension elements act on the fundamental waves (low band) substantially without negative effects on the characteristics of the harmonic waves (high band). Therefore, the antenna efficiency in the low band can be effectively improved as shown in FIGS. 8A and 8B.

Figure 9:
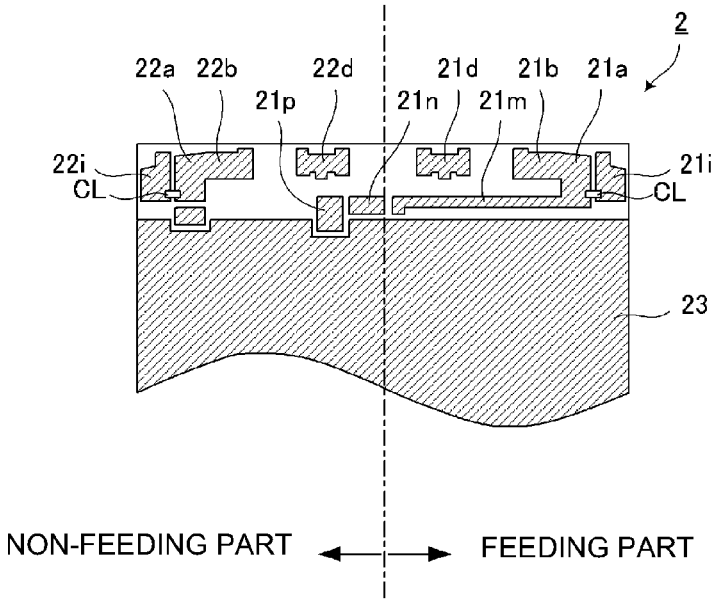
FIG. 9 is a top view illustrating electrode patterns formed on a substrate used for an antenna according to another exemplary embodiment.
Figure 10:
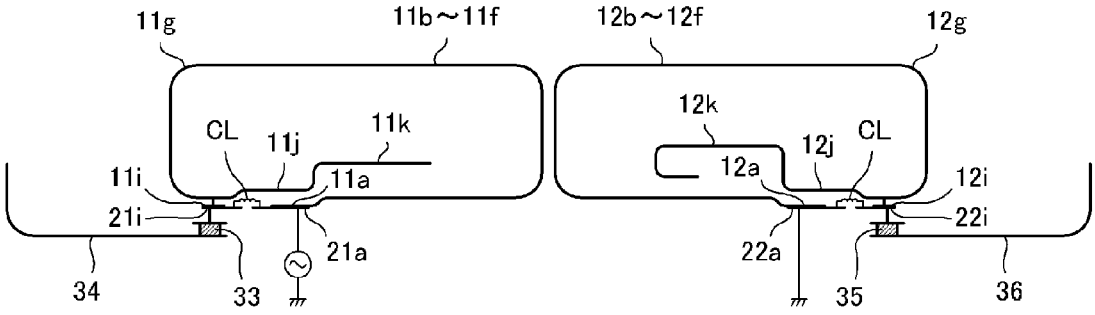
FIG. 10 is an equivalent circuit diagram of the antenna according to the exemplary embodiment shown in FIG. 9.
Figure 11:
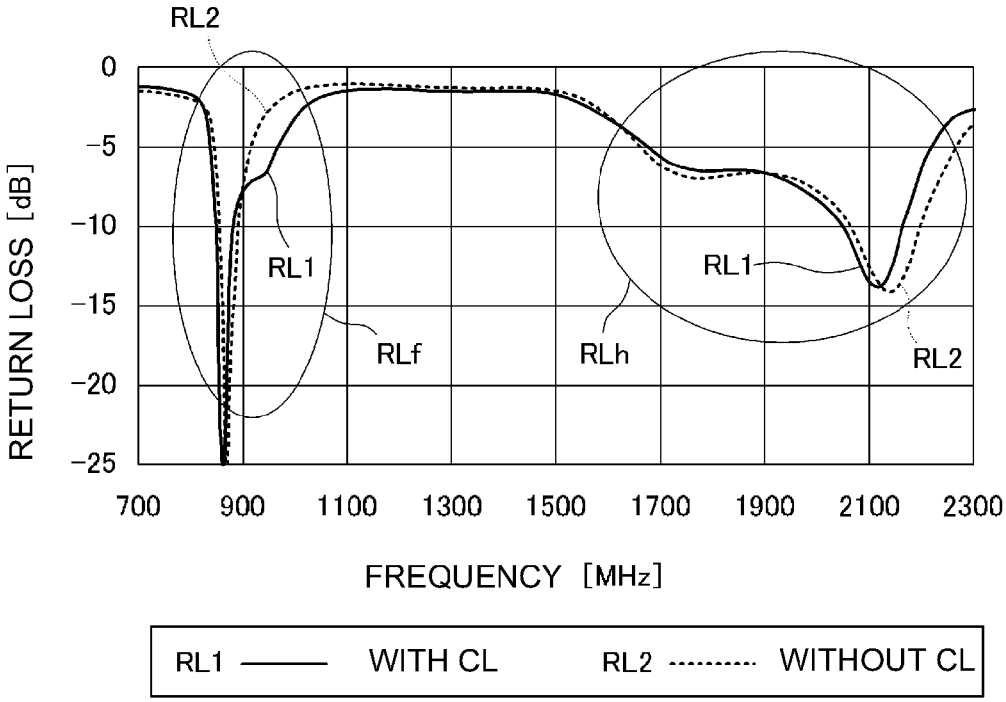
FIG. 11 illustrates a reflection characteristic of the antenna according to the exemplary embodiment shown in FIG. 9.

With reference to FIGS. 9 to 11, a second exemplary embodiment will now be described. A substrate used in an antenna according to a second exemplary embodiment is the same as the substrate 2 according to the first exemplary embodiment shown in FIG. 2. The structure of an antenna element is also the same as the antenna element 1 according to the first embodiment shown in FIGS. 2 and 3A to 3F.

FIG. 9 is a top view illustrating electrode patterns formed on the substrate 2 used for the antenna according to the second exemplary embodiment.

As shown in FIG. 9, the structure of a feeding part of the second exemplary embodiment includes a first external-terminal electrode 21*i*, a feeding terminal electrode 21*a*, and electrodes 21*b* and 21*d* are formed on the top surface of the substrate 2 in an ungrounded area. In addition, an electrode 21*m* extending from the feeding terminal electrode 21*a* and discrete electrodes 21*n* and 21*p* separated from the end portion of the electrode 21*m* are formed on the substrate 2.

The first external terminal 11*i* shown in FIG. 3C is connected to the first external-terminal electrode 21*i*. Moreover, the feeding terminal 11*a* of the antenna element 1 is connected to the feeding terminal electrode 21*a*. Similarly, the electrodes 11*b* and 11*d* of the antenna element 1 are connected to the electrodes 21*b* and 21*d*, respectively, on the substrate 2.

A feeding circuit (transmitter/receiver circuit) is connected between the electrode 21*m* extending from the feeding terminal electrode 21*a* and a ground electrode 23. Moreover, chip capacitors or chip inductors for a matching circuit are disposed, for example, between the electrode 21*n* and the ground electrode 23, between the electrode 21*p* and the ground electrode 23, between the electrode 21*n* and the electrode 21*m*, and between the electrode 21*p* and the electrode 21*m*.

The structure of a non-feeding part includes a second external-terminal electrode 22*i*, a ground terminal electrode 22*a*, and electrodes 22*b* and 22*d* are formed on the top surface of the substrate 2 in the ungrounded area.

The second external terminal 12*i* shown in FIG. 3C is connected to the second external-terminal electrode 22*i*. Moreover, the ground terminal 12*a* of the antenna element 1 is connected to the ground terminal electrode 22*a*. Similarly, the electrodes 12*b* and 12*d* of the antenna element 1 are connected to the electrodes 22*b* and 22*d*, respectively, on the substrate.

The second exemplary embodiment differs from the first exemplary embodiment in that chip inductors CL are disposed between the first external-terminal electrode 21*i* and the feeding terminal electrode 21*a* and between the second external-terminal electrode 22*i* and the ground terminal electrode 22*a*.

FIG. 10 is an equivalent circuit diagram of the antenna according to the second exemplary embodiment. This antenna differs from that according to the first exemplary embodiment shown in FIG. 5 in that the antenna includes the chip inductors CL.

FIG. 11 illustrates a reflection characteristic of the antenna according to the second embodiment. In FIG. 11, a portion of a small return loss indicated by RLf in a low frequency band corresponds to the resonance in the fundamental wave mode, and that indicated by RLh in a high frequency band corresponds to the resonance in the harmonic wave mode. As is clear from FIG. 11, the antenna resonates at two frequencies using the feeding radiation electrode and the non-feeding radiation electrode.

In the fundamental wave mode, current flows through the looped radiation electrode 11 (11*a*, 11*b* to 11*f*, 11*g*, and 11*j*) of the feeding part from a feeding end to an open end thereof when the chip inductors CL do not exist in FIG. 10. When the chip inductor CL is connected between the first external-terminal electrode 21*i* and the feeding terminal electrode 21*a*, a shortcut through the chip inductor is formed between a predetermined point of the radiation electrode 11 and the feeding end. Consequently, two current paths through the loop and through the chip inductor are formed. With this, the equivalent electrical length of the radiation electrode 11 is reduced, and the resonant frequency in the fundamental wave mode is increased. FIG. 11 shows this fact.

Moreover, the proportion of the amount of current passing through the current path through the chip inductor CL among the two current paths is increased as the inductance of the chip inductor CL is reduced, and the equivalent electrical length of the radiation electrode is further reduced. With this, the resonant frequency in the fundamental wave mode is further increased.

In the harmonic wave mode, the proportion of the amount of current passing through the chip inductor is small since the frequency is higher than the resonant frequency in the fundamental wave mode. Therefore, the resonant frequency in the harmonic wave mode does not change substantially in the range of the inductance of the chip inductor used for controlling the resonant frequency in the fundamental wave mode.

The first external terminal 11*i*, the second external terminal 12*i*, the first external-terminal electrode 21*i*, and the second external-terminal electrode 22*i* are used for connecting the chip inductors in addition to connecting extension elements. In this manner, the frequencies of the fundamental waves (low band) can be easily set separately from the frequencies of the harmonic waves.

Figure 12:
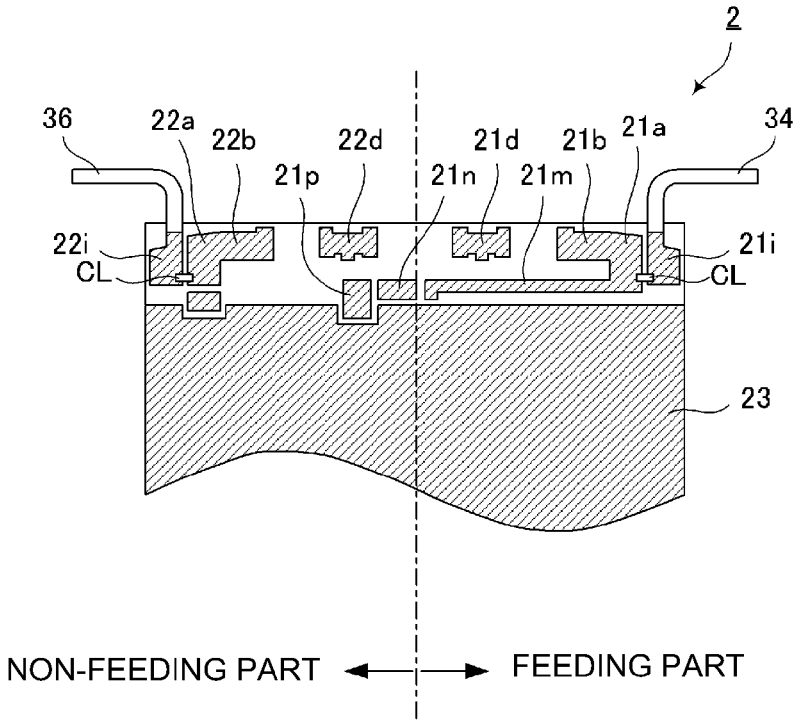
FIG. 12 is a top view illustrating electrode patterns formed on a substrate used for an antenna according to another exemplary embodiment.

With reference to FIG. 12, an antenna according to a third exemplary embodiment will now be described. A substrate 2 used for an antenna according to the third embodiment is the same as the substrate 2 according to the first embodiment shown in FIG. 2. The structure of an antenna element is also the same as the antenna element 1 according to the first embodiment shown in FIGS. 2 and 3A to 3F. That is, the substrate and the antenna element used for the antenna are common in the first to third exemplary embodiments.

FIG. 12 is a top view illustrating electrode patterns formed on the substrate 2 used the antenna according to the third embodiment. Extension elements 34 and 36 extend from the top surface of the substrate 2. Extension element 34 is connected to a first external-terminal electrode 21*i*, and extends from the first external-terminal electrode 21*i* so as to be separated from a ground electrode 23. Similarly, an extension element 36 is connected to a second external-terminal electrode 22*i*, and extends from the second external-terminal electrode 22*i* so as to be separated from the ground electrode 23. These extension elements 34 and 36 are, for example, molded metallic plates.

In the first to third embodiment, the antenna includes both the feeding and non-feeding radiation electrodes. However, the present invention is not limited to this, and can be incorporated into an antenna without the non-feeding radiation electrode (consequently, without the extension element in the non-feeding part).

The extension elements 34 and 36 are disposed in the feeding part and the non-feeding part, respectively, in the first to third embodiments. However, the present invention is not limited to this, and an extension element can be disposed only in the feeding part or in the non-feeding part.

Embodiments consistent with the claimed invention can have improved antenna performance because either or both of the electric field of the fundamental wave excited by the feeding radiation electrode and that of the fundamental wave excited by the non-feeding radiation electrode can be widely distributed.

Moreover, the frequencies of the fundamental waves (low band) can be easily adjusted without changing the frequencies of the harmonic waves (high band) since the extension elements are connected at the nodes of the voltage-intensity distributions of the harmonic waves.

Furthermore, flexibility in designing can be improved since the use or disuse of the extension elements can be selected even after the design of the antenna shape has been completed.

Although a limited number of exemplary embodiments of the invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. An antenna comprising:

an antenna element including a dielectric base having a feeding radiation electrode formed on the dielectric base;

a substrate having a ground electrode and an ungrounded area in which no ground electrode is formed provided at an end portion of the substrate, the antenna element being provided in the ungrounded area of the substrate; and a first extension element, wherein the feeding radiation electrode has a feeding terminal at a feeding end thereof and extends along a surface of the dielectric base in a helical or looped manner so as to return to a position adjacent to the feeding terminal, the feeding radiation electrode has a first external terminal at a position on the dielectric base substantially corresponding to a node of the distribution of voltage intensity of a harmonic wave distributed in the feeding radiation electrode, the substrate includes a first external-terminal electrode to which the first external terminal is connected, and the first extension element extends from the first external-terminal electrode so as to be separated from the ground electrode.

2. The antenna according to claim 1, further comprising:

a second extension element, wherein the dielectric base has a non-feeding radiation electrode formed thereon in addition to the feeding radiation electrode, the non-feeding radiation electrode has a ground terminal at a ground end thereof and extends along the surface of the dielectric base in a helical or looped manner so as to return to a position adjacent to the ground terminal, the non-feeding radiation electrode has a second external terminal at a position on the dielectric base substantially corresponding to a node of the distribution of voltage intensity of a harmonic wave distributed in the non-feeding radiation electrode, the substrate has a second external-terminal electrode to which the second external terminal is connected, and the second extension element extends from the second external-terminal electrode so as to be separated from the ground electrode.

3. The antenna according to claim 2, wherein the substrate has a feeding terminal electrode to which the feeding terminal is connected and a ground terminal electrode to which the ground terminal is connected, and an inductance element is connected either or both between the first external-terminal electrode and the feeding terminal electrode and between the second external-terminal electrode and the ground terminal electrode.

4. The antenna according to claim 3, wherein at least one of the first extension element or the second extension element is disposed inside a casing, and the first extension element is electrically connected to the first external-terminal electrode with a flexible or elastic connecting member interposed therebetween or the second extension element is electrically connected to the second external-terminal electrode with a flexible or elastic connecting member interposed therebetween.

5. A radio communication device comprising an antenna according to claim 4 inside a casing of the device.

6. A radio communication device comprising an antenna according to claim 3 inside a casing of the device.

7. The antenna according to claim 2, wherein at least one of the first extension element or the second extension element is disposed inside a casing, and the first extension element is electrically connected to the first external-terminal electrode with a flexible or elastic connecting member interposed therebetween or the second extension element is electrically connected to the second external-terminal electrode with a flexible or elastic connecting member interposed therebetween.

8. A radio communication device comprising an antenna according to claim 7 inside a casing of the device.

9. A radio communication device comprising an antenna according to claim 2 inside a casing of the device.

10. The antenna according to claim 1, wherein the substrate has a feeding terminal electrode to which the feeding terminal is connected, and an inductance element is connected between the first external-terminal electrode and the feeding terminal electrode.

11. The antenna according to claim 10, wherein the first extension element is disposed inside a casing, and the first extension element is electrically connected to the first external-terminal electrode with a flexible or elastic connecting member interposed therebetween.

12. A radio communication device comprising an antenna according to claim 11 inside a casing of the device.

13. A radio communication device comprising an antenna according to claim 10 inside a casing of the device.

14. The antenna according to claim 1, wherein the first extension element is disposed inside a casing, and the first extension element is electrically connected to the first external-terminal electrode with a flexible or elastic connecting member interposed therebetween.

15. A radio communication device comprising an antenna according to claim 14 inside a casing of the device.

16. A radio communication device comprising an antenna according to claim 1 inside a casing of the device.

* * * * *